US006120237A

United States Patent [19]

Cummings et al.

[11] Patent Number: 6,120,237

[45] Date of Patent: Sep. 19, 2000

[54] ATTACHMENT FOR GROUNDWORKING AND MATERIAL HANDLING MACHINES AND A STRUT ASSEMBLY THEREFOR

[75] Inventors: David C. Cummings, Charlotte, N.C.; Ashley Heiple, Alum Bank, Pa.

[73] Assignee: Rockland Inc., Bedford, Pa.

[21] Appl. No.: 09/139,467

[22] Filed: Aug. 25, 1998

[51] Int. Cl.[7] ..... B66C 1/00

[52] U.S. Cl. ..... 414/729; 37/403; 91/437; 414/727

[58] Field of Search ..... 414/729, 724; 37/403, 405, 406, 407; 91/437, 436

[56] References Cited

U.S. PATENT DOCUMENTS

| | | | |
|---|---|---|---|
| 4,375,345 | 3/1983 | Hanson | 37/406 X |
| 4,840,111 | 6/1989 | Garnjost | 91/437 X |
| 5,553,408 | 9/1996 | Townsend | 37/406 |
| 5,678,332 | 10/1997 | Hawkins | 37/406 X |

*Primary Examiner*—Donald W. Underwood
*Attorney, Agent, or Firm*—Lalos & Keegan; Michael N. Lau

[57] ABSTRACT

An attachment connectable to a boom member of a machine for performing work functions generally consisting of a handle pivotally connectable to a boom member of the machine, a ground engageable arm member pivotally connected to the handle and an extendable strut assembly interconnecting the handle and arm member consisting of a hydraulic cylinder assembly having a cylinder member pivotally connected to the handle and a rod member pivotally connected to the arm member, and including means intercommunicating the base and rod ends of the cylinder member, at least one electrically operable valve disposed in the intercommunicating means and operatively connectable to control means disposed on the machine, selectively operable to open the valve and permit the free flow of fluid between the base and rod ends of the cylinder member, and correspondingly the angular displacement of the arm member relative to the handle upon maneuvering the arm member by an operator of the machine, and to close and preclude the free flow of fluid between the base and rod ends of the cylinder member, and correspondingly the angular displacement of the arm member relative to the handle, and an accumulator selectively communicable with the variable volume chambers of the cylinder for compensating for the fluid volume differential of such chambers.

16 Claims, 6 Drawing Sheets

ATTACHMENT FOR GROUNDWORKING AND MATERIAL HANDLING MACHINES AND A STRUT ASSEMBLY THEREFOR

This invention relates to an attachment for groundworking and material handling machines, and more particularly to an attachment operable for performing various work functions. The invention further contemplates a novel strut assembly for such an attachment.

BACKGROUND OF THE INVENTION

In many groundworking and material handling machines, there generally is provided a mobile support frame mounted on wheels or track units, a rotatable platform mounted on the support frame on which there is provided an operator's station and a boom mounted on the platform and angularly displaceable about a horizontal axis. Typically, the front end of the machine further is provided with a handle or dipper stick pivotally connected to the free end of the boom and some form of groundworking or material handling assembly mounted on the free end of the handle or dipper stick. Such assemblies typically consist of an excavator bucket, a rake, a pair of jaws such as in a grapple or sets of shears or crushers and the like. In most of such constructions, the boom, handle or dipper stick and the assembly mounted on the handle or dipper stick are pivoted by hydraulic cylinder assemblies. In some applications, where the working assembly consists of a pair of jaws, it is common to provide for the pivotal movement of both jaws, the pivotal movement of only one jaw and the fixed positioning of the other jaw or the pivotal movement of one jaw and the fixed positioning of the other jaw but the angular adjustment of the position of the fixed jaw.

In one common attachment for machines of the type described, there is provided at least a lower jaw member sometimes referred to as a "thumb" pivotally connected to the underside of the handle of the machine, a hydraulic cylinder assembly operatively interconnecting the underside of the handle and the lower jaw member for angularly displacing the lower jaw member relative to the handle, and often an upper jaw member in the form of a bucket, grapple jaw, shear blade, rock crushing jaw, rake or the like, pivotally connected to the handle, in which the lower fixed jaw member may be used independently of or in cooperation with the upper jaw to perform various work functions.

In the type of attachment described, in adjusting the angle of the lower jaw member relative to the handle, it has been the common practice in the prior art simply to operate certain controls at the operator's station on the machine to supply and withdraw fluid to and from opposite ends of the cylinder assembly interconnecting the handle of the machine and the lower jaw member to extend or retract the rod portion thereof, correspondingly adjusting the angle of the lower jaw member, and then blocking the flow of fluid to and from the opposite ends of the cylinder assembly to lock the rod portion thereof and thus provide a strut of a fixed length.

Such type of arrangement, however, is relatively costly to manufacture in that it requires running fluid supply and return lines from the platform of the machine along the boom and handle to the cylinder assembly for the lower jaw member. Such fluid supply and return lines and the various fittings required add considerably to the cost of such attachments. Furthermore, such lines are vulnerable to damage and require periodic maintenance.

It thus has been found to be desirable to provide the type of attachment as described which not only provides for an expeditious angular adjustment of the lower jaw member and a rigid strut therefor for withstanding substantial loads imposed thereon in performing various work functions but further an avoidance of the relatively high manufacturing costs and potential maintenance problems inherent in comparable prior art attachments.

SUMMARY OF THE INVENTION

The present invention provides an improvement over comparable attachments in providing an attachment connectable to a boom of a machine such as a groundworking machine or a material handling machine generally comprising a handle pivotally connectable to the boom of the machine, an arm member pivotally connected to the handle and an extendable strut interconnecting the handle and the arm member consisting of a hydraulic cylinder assembly having a cylinder member pivotally connected to the underside of the handle and a rod member pivotally connected to the arm member. The strut further includes means intercommunicating the base and rod ends of the cylinder member, at least one electrically operated valve disposed in such intercommunicating means and operatively connectable to control means provided at the operator's station on the machine, selectively operable to open such valve and thus permit the free flow of fluid between the base and rod ends of the cylinder member, and correspondingly the angular displacement of the arm member relative to the handle upon maneuvering the front end of the machine by the operator, and close such valve and thus preclude the free flow of fluid between the base and rod ends of the cylinder member, and correspondingly the setting of the angular relationship of the arm member relative to the handle, and an accumulator selectively communicable with the variable volume chambers of the cylinder member for compensating for the fluid volume requirements of such chambers.

DESCRIPTION OF PREFERRED EMBODIMENTS OF THE INVENTION

Figure 1:
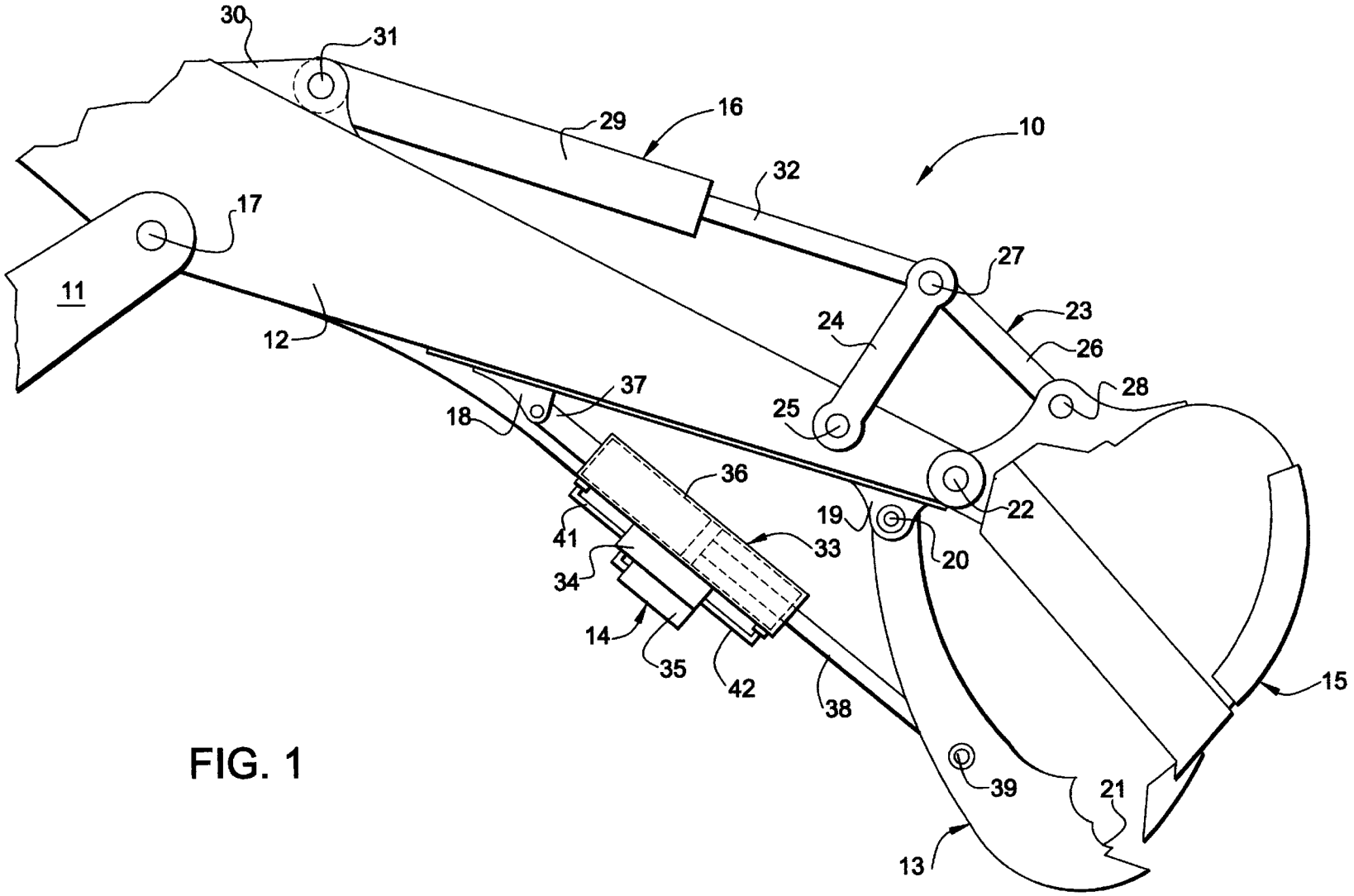
FIG. 1 is a side view of the front end of a groundworking machine which embodies the present invention.

Referring to FIG. 1, there is shown an attachment 10 mountable on the free end of a boom 11 mounted on a conventional groundworking or material handling machine, which embodies the present invention. The attachment includes a handle or dipper stick 12, a depending arm member 13 commonly referred to as a "thumb", a strut assembly 14 operatively interconnecting the lower side of the handle and the arm member, a bucket 15 and a cylinder assembly 16. The handle is pivotally connected at its inner end to boom 11 by means of a shaft 17 and is provided with a pair of depending brackets 18 and 19. Arm member 13 is pivotally connected at its upper end to bracket 19 by means of a connecting pin 20. The lower, forwardly facing end of the arm member may be provided with a serrated or jagged configuration as at 21 which may be used to break up earth, rock, cement or paved surfaces in the conventional manner.

Bucket 15 is of a conventional configuration and is pivotally connected to the free end of handle 12 by means of a connecting pin 22. The bucket is adapted to be operated either independently or in cooperation with arm member 13 as when it is desired to grapple a large rock or a tree trunk. The bucket is adapted to pivot relative to the handle by means of hydraulic cylinder assembly 16 and a linkage assembly 23. The linkage assembly includes a first link 24 pivotally connected to the front end of handle 12 by means of a connecting pin 25 and a link 26 pivotally connected to link 24 by means of a connecting pin 27 and also pivotally connected to bucket 15 by means of a connecting pin 28. Hydraulic cylinder assembly 16 includes a cylinder member 29 pivotally connected at the base end thereof to a bracket 30 provided on the upper side of handle 12 by means of a connecting pin 31 and a rod member 32 pivotally connected at its free end to connecting pin 27.

Strut assembly 14 generally includes a hydraulic cylinder assembly 33, a control valve 34 and an accumulator 35. The cylinder assembly consists of a cylinder member 36 connected at its base end to depending bracket 18 by means of a connecting pin 37 and a rod member 38 pivotally connected to an intermediate portion of arm member 13 by means of a connecting pin 39. Control valve 34 and accumulator 35 are mounted on cylinder member 36 which functions to control the intercommunication of fluid between the base and rod ends of cylinder 36.

Figure 2:
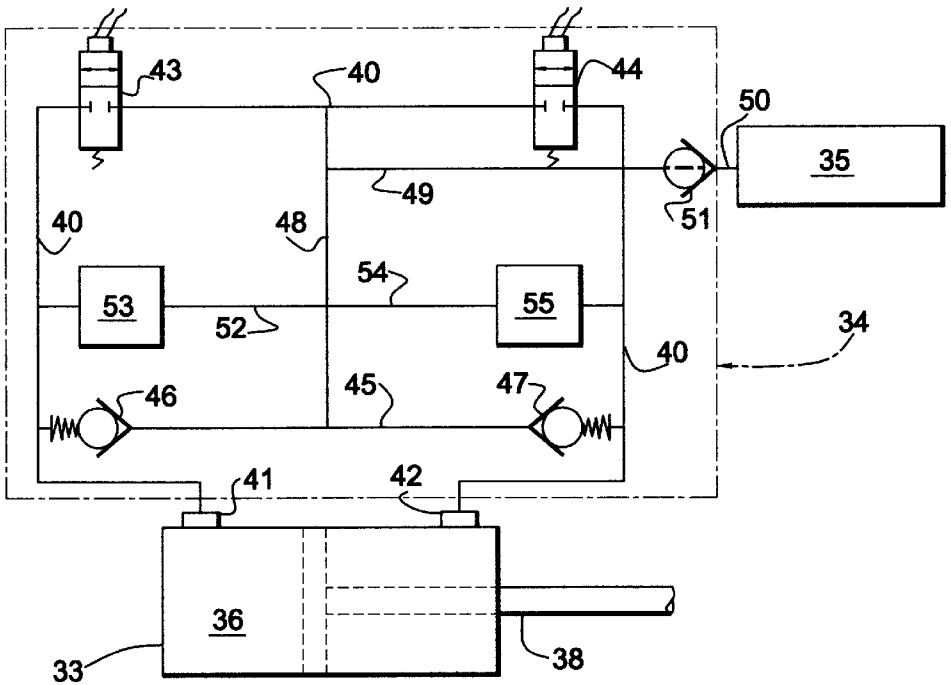
FIG. 2 is a diagrammatic drawing of the strut assembly shown in FIG. 1.

Strut assembly 14 and particularly control valve 34 is best illustrated diagrammatically in FIG. 2. The valve includes a fluid passageway 40 intercommunicating the base and rod ends of cylinder member 36 by means of fluid lines 41 and 42, and including a pair of electrically actuated valves 43 and 44 normally disposed in the closed condition, a fluid passageway 45 interconnecting portions of fluid passageway 40, disposed parallel to a segment of fluid passageway 40 including valves 43 and 44, and including a pair of check valves 46 and 47 permitting fluid flow therefrom only in the direction of fluid passageway 40. Fluid passageway 40 and passageway 45 are interconnected by means of a fluid passageway 48 interconnecting a portion of passageway 40 disposed between valves 43 and 44 and a portion of passageway 45 disposed between check valves 46 and 47. A fluid passageway 49 intercommunicates passageway 48 and a fluid line 50 of accumulator 35, and includes a check valve 51. Valve 51 is provided with an orifice and functions in a manner to provide restricted flow of fluid from passageway 49 into accumulator 35 and unrestricted flow of fluid out of the accumulator into passageway 49. Valve 34 further includes a fluid passageway 52 intercommunicating a portion of fluid passageway 40 between fluid line 41 and valve 43, and fluid passageway 48, including a pressure relief valve 53. Similarly, the valve is provided with a passageway 54 intercommunicating fluid passageway 48 and the portion of passageway 40 between valve 44 and fluid line 42, which includes a pressure relief valve 55.

Control valve 34 is selectively operable to open, permitting the free flow of fluid between the base and rod ends of the cylinder member and thus adjustment of its length and correspondingly an angular adjustment of the arm member relative to the handle, and to open, precluding the free flow of fluid between the base and rod ends of the cylinder member and thus the fixing of its length and correspondingly the setting of the angular relationship of the arm member relative to the handle. In the condition as shown in FIG. 2, intercommunication of fluid between the base and rod ends of the cylinder member is precluded. Whenever it is desired to adjust the angular relationship of arm member 13 relative to handle 12 by adjusting the length of strut assembly 14, the machine operator need only operate controls at the operator's station to open valves 43 and 44, maneuver the boom and handle to cause arm member 13 to pivot and thus assume a different angular relationship relative to the handle, and then close valves 43 and 44 to lock the strut assembly and thus fix the angular relationship of the arm member relative to the handle.

When valves 43 and 44 are in the open position and the operator operates the controls of the machine to cause the lower end of the arm member to engage the ground and pivot rearwardly to shorten the length of the strut assembly, fluid will flow from the base end of cylinder member 36 through fluid line 41, fluid passageway 40 including valve 43, passageway 48, passageway 45 including check valve 47, a segment of passageway 40 and fluid line 42 into the rod end of the cylinder member. Excess fluid from the base end of cylinder member 36 will be caused to flow through passageway 49 and the restriction of check valve 51 into accumulator 35. When the position of arm member 13 is set at the desired angle relative to the handle and it is desired to lock the member in such position, the operator merely operates controls at his station to close valves 43 and 44 to preclude intercommunication between the base and rod ends of cylinder member 36 and correspondingly fix the length of the strut assembly.

When the operator opens valves 43 and 44 and maneuvers other controls on the machine to cause arm member 13 to engage the ground and be pivoted forwardly to extend rod member 38, fluid will be caused to flow out of the rod end of cylinder member 36 through fluid line 42, the portion of fluid passageway 40 including valve 44, passageway 48, a portion of passageway 45 including check valve 46, a portion of passageway 40 and fluid line 41 into the base end of cylinder member 36. Since the volume of the chamber at the rod end of cylinder member 36 is less than the volume of the chamber at the base end of the cylinder member, and there accordingly would be a deficiency of fluid flowing from the rod end to the base end of the cylinder member, such deficiency is compensated for by fluid supplied by accumulator 35 through check valve 51 and fluid passageway 49.

In the use of the attachment as shown, the operator may utilize arm member 13 to perform a variety of work functions. In doing so, if an excessive load is applied to arm member 13, risking damage to the arm member, pressure relief valves 53 and 55 will be caused to open providing intercommunication of fluid between the base and rod ends of the cylinder member and thus permitting the pivotal movement of the arm member to relieve it of the stress resulting from the undue load imposed thereon.

In lieu of a pair of hydraulic lines extending from cylinder member 36 along handle 12 and boom 11 down to a fluid supply source on the support platform of the machine, there is provided simply electrical lead wires from valves 43 and 44 extending to suitable electrical controls provided at the operator's station on the machine. Such lead wires may easily be attached to the handle and boom members and suitably sheltered from any damage. Furthermore, such lead wires would require no special fittings and would not be subject to leakage as in hydraulic lines.

Figure 3:
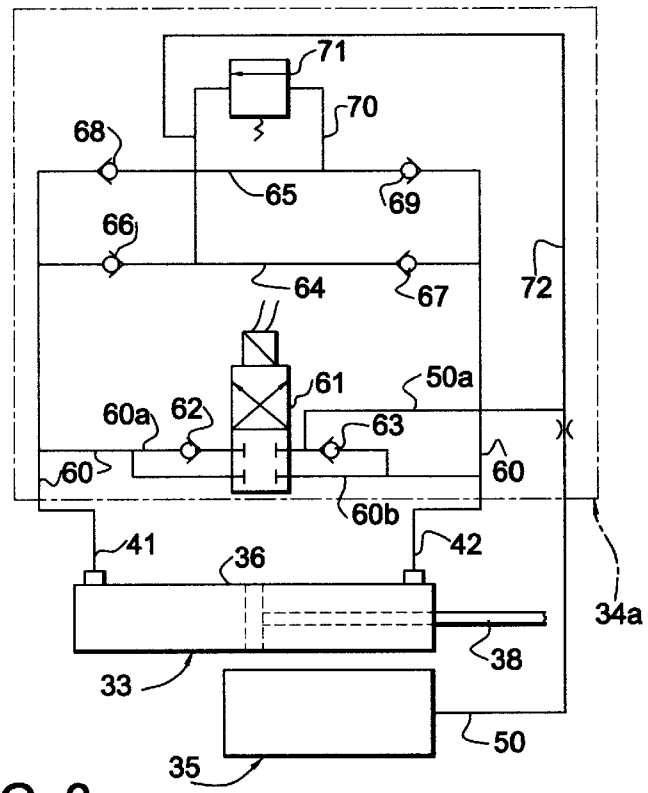
FIG. 3 is a diagrammatic drawing of another embodiment of the strut assembly shown in FIG. 1.

FIG. 3 illustrates diagrammatically another embodiment of the strut assembly utilizing a modified control valve 34a. The valve includes a fluid passageway 60 communicating with opposite ends of cylinder member 36 through fluid lines 41 and 42. Passageway 60 includes parallel line segments 60*a* and 60*b* which include an electrically actuated valve 61. Passageway 60*a* further is provided with a pair of check valves 62 and 63 which allow the flow of fluid from valve 61. Fluid line 50 of accumulator 35 communicates through a passageway 50*a* with fluid passageway segment 60*a* at a point between valve 61 and check valve 63. Connected parallel with the portion of fluid line 60 including valve 61 is a pair of fluid lines 64 and 65. Passageway 64 includes a pair of check valves 66 and 67 adapted to permit flow of fluid to fluid passageway 60, and fluid passageway 65 includes a pair of check valves 68 and 69 operable to allow the flow of fluid from fluid passageway 60. A fluid passageway 70 interconnects the portions of fluid passageways 64 and 65 at points between the check valves thereof, and includes a pressure relief valve 71 which is adapted to open under a predetermined pressure. Fluid passageway 70 further communicates with fluid passageway 50*a* through a passageway 72.

In the operation of the strut assembly shown in FIG. 3, when the machine operator operates the front end of the machine to cause rod member 38 to retract, fluid from the base end of cylinder member 38 will flow through fluid line 41, fluid passageway 60 including valve 61 and check valve 63 and fluid line 42 into the rod end of cylinder member 36. Excess fluid corresponding to the larger chamber volume of the base end of the cylinder compared to the rod end thereof is caused to flow through passageway 50*a* and fluid line 50 to accumulator 35. Under circumstances where the front end of the machine is maneuvered to extend rod 38, fluid from the rod end of cylinder member 36 will be caused to flow through fluid line 42, fluid passageway 60 including valve 61 and check valve 62 and fluid line 41 to the base end of cylinder member 36. The deficiency of fluid caused by the disparity of the volumes of the chambers on the base and rod ends of cylinder member 36 is compensated for by supplying make-up fluid from accumulator 35 through fluid line 50 and fluid passageway 50*a*.

Whenever the operator may have positioned arm member 13 at a desired angle relative to handle 12, he may fix the position of the arm member simply by closing valve 61 to preclude the flow of fluid in fluid passageway 60 thus locking the rod member and correspondingly fixing the length of cylinder assembly 33. In the operation of the attachment with arm member 13 in a fixed angular position relative to handle 12, whenever any excess load is imposed on the arm member which might have the tendency to damage such member, the increased pressure imposed on rod member 38 will cause pressure relief valve 71 to open and thus allow intercommunication of fluid between the base and rod ends of cylinder member 36, permitting the rod member to extend or retract. Upon opening of pressure relief valve 71, an excess or deficiency of fluid required by cylinder member 36 will be provided for by accumulator 35 through fluid passageway 72.

Figure 4:
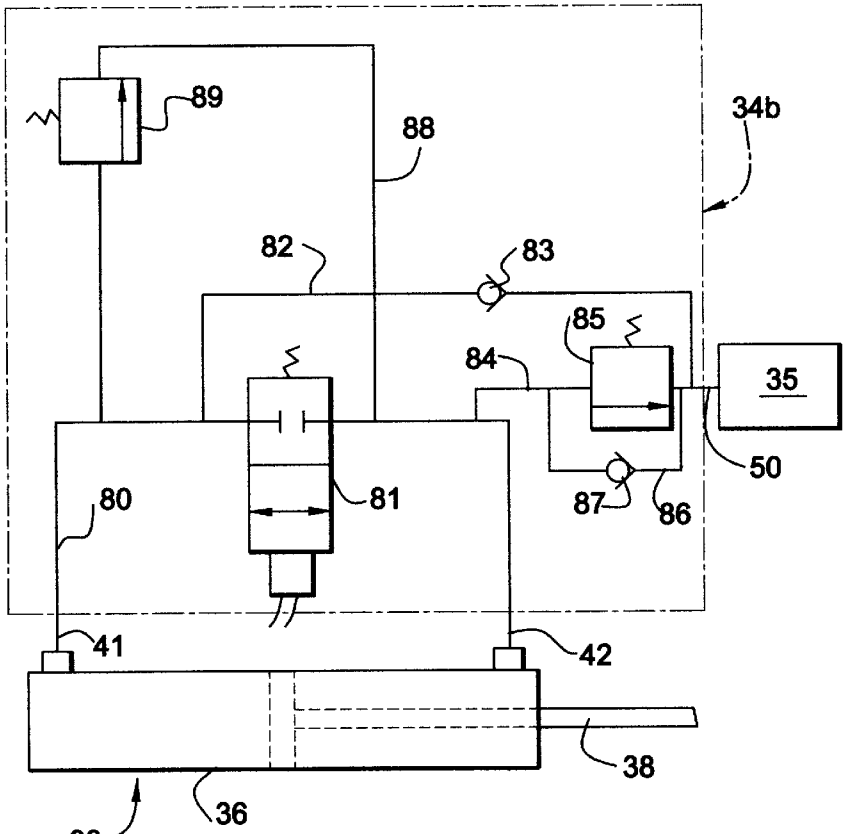
FIG. 4 is a diagrammatic drawing of a further embodiment of the strut assembly shown in FIG. 1.

The embodiment shown in FIG. 4 includes a modified control valve 34*b*. In such embodiment, there is provided a fluid passageway 80 intercommunicating the base and rod ends of cylinder member 36 through fluid lines 41 and 42, which includes an electrically actuated valve 81. Intercommunicating fluid passageway 80 and fluid line 50 of the accumulator are a fluid passageway 82 connected to passageway 80 on one side of valve 81 and including a check valve 83 operable to allow flow from the accumulator to passageway 80, and a fluid passageway 84 connected to passageway 80 on the other side of valve 81 and including a pressure responsive valve 85 which is normally in the closed position and adapted to open under a predetermined pressure in passageway 80 to allow the flow of fluid to accumulator 35. A fluid passageway 86 is connected to fluid passageway 84 in parallel with pressure responsive valve 85 and includes a check valve 87 operable to permit the flow of fluid from accumulator 35 to fluid passageway 80. Also connected to fluid passageway 80 in parallel with valve 81 is a fluid passageway 88 including a pressure relief valve 89.

With valve 81 in the closed condition as shown in FIG. 4, rod member 38 will be prevented from extending or retracting thus causing arm member 13 to maintain a fixed angular position relative to handle 12. Whenever it is desired to adjust the angular relationship of arm member 13 relative to the handle, the machine operator simply operates certain controls to open valve 81 permitting free intercommunication of fluid between the base and rod ends of cylinder member 36, allowing him to maneuver the front end of the machine to adjust the angular relationship of arm member 13 relative to handle 12. As the operator maneuvers the front end of the machine to adjust the angular relationship of the arm member relative to the handle, rod member 38 will be caused to extend or retract, altering the length of the strut assembly. When the rod member retracts, fluid from the base end of the cylinder member will be caused to flow through fluid passageway 80 and opened valve 81 to rod end of the cylinder. Increased pressure in fluid passageway 80 caused by excess fluid being supplied by the base end of cylinder member 36 will cause pressure responsive valve 85 to open and allow such excess fluid to flow to accumulator 35. When rod member 38 is caused to extend, fluid from the rod end of cylinder member 36 will flow in the opposite direction through fluid passageway 80 and open valve 81 to the base end of cylinder member 36. Additional fluid required to be supplied to the base end of cylinder member 36 is provided by accumulator 35 through fluid passageways 86 and 84.

When the operator has positioned arm member 13 relative to handle 12 at the desired angle, he merely operates a suitable control at the operator's station to close valve 81 and thus preclude intercommunication between the base and rod ends of cylinder member 36. The arm member would then be fixed in position relative to the handle so that the operator could proceed with the intended work function. In the event any excess load is imposed on the arm member, such excess load will cause pressure relief valve 89 to open, permitting intercommunication between the base and rod ends of cylinder member 36 and correspondingly the unlocking of rod member 38 to permit the arm member to move relative to the handle.

Figure 5:
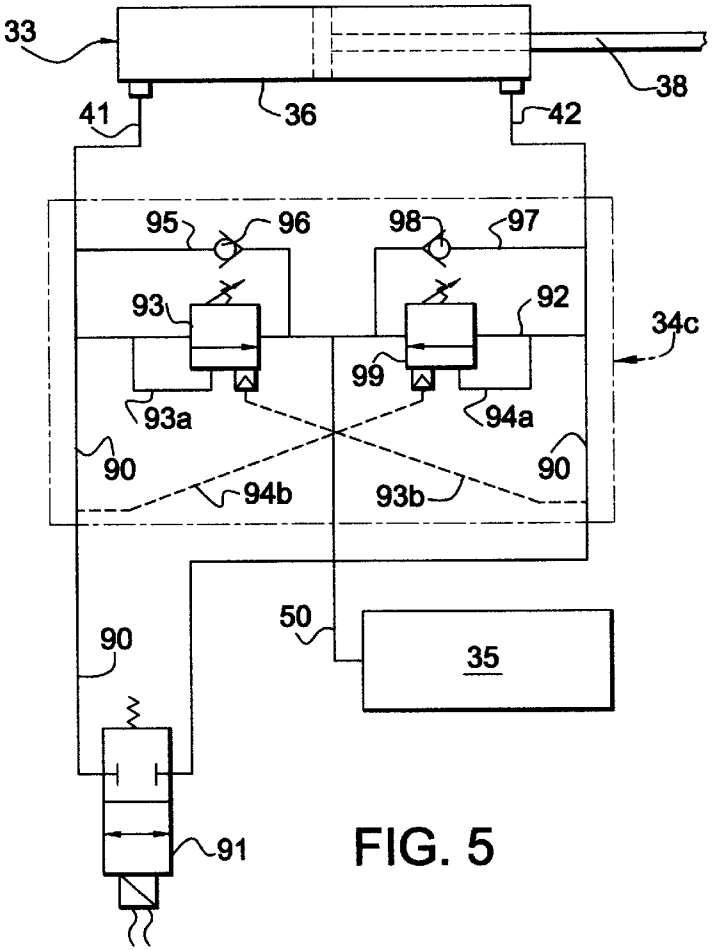
FIG. 5 is a diagrammatic drawing of a still further embodiment of the strut assembly shown in FIG. 1.

The embodiment shown in FIG. 5 includes a further modified control valve 34*c* which functions to permit the displacement or locking of rod member 38. The valve includes a fluid passageway 90 intercommunicating the base and rod ends of cylinder member 36 through fluid lines 41 and 42, and including an electrically operated valve 91 normally disposed in the closed condition. Interconnecting portions of fluid passageway 90 and disposed parallel to valve 91 is a fluid passageway 92 provided with pressure responsive valves 93 and 94 normally disposed in the closed condition. Valve 93 is adapted to open responsive to a predetermined pressure in the base end of cylinder member 36 by means of a branch passageway 93*a*, and valve 94 is adapted to open responsive to a predetermined pressure in the rod end of cylinder member 36 by means of a branch passageway 94*a*. Such valves further are adapted to open responsive to predetermined pressures in the base and rod ends of cylinder member 36 through fluid passageways 93*b* and 94*b*. A branch passageway 95 interconnects fluid passageways 90 and 92 in parallel to valve 93 and includes a check valve 96 permitting the flow of fluid through passageway 95 and a portion of passageway 90 to the base end of cylinder member 36. Similarly, a branch line 97 interconnects fluid passageway 92 and a portion of fluid passageway 90 in parallel to valve 94 which includes a check valve 98 allowing the flow of fluid through fluid passageway 97 to the rod end of cylinder member 36. The portion of fluid passageway 92 disposed between valves 93 and 94 is connected to fluid line 50 of accumulator 35 through a fluid passageway 99.

In the operation of the valve shown in FIG. 5, when valve 91 is closed by the operator and rod member 38 is caused to retract, fluid from the base end of cylinder member 36 will be caused to flow through fluid passageway 90 including valve 91 to the rod end of cylinder member 36. Increased pressure in the base end of cylinder member 36 caused by the excess fluid sought to be transmitted to the rod end of the cylinder member will cause pressure responsive valves 93 and 94 to open to permit excess fluid from the base end of cylinder member 36 to flow to the accumulator through fluid passageway 99 and fluid line 50. When rod member 38 is extended fluid from the rod end of cylinder member 36 will be caused to flow in the opposite direction in fluid passageway 90 to the base end of cylinder member 36. The deficiency of fluid supplied to the base member of the cylinder member is compensated for by fluid supplied by accumulator 35 through check valves 96 and 98. Whenever arm member 13 is positioned at an angle relative to the handle desired by the operator, the operator may fix such position by merely closing valve 91.

Upon operation of the front end of the machine with the arm member in the fixed position relative to the handle, whenever any excess load is imposed on the arm member, placing an undue load on rod member 38, such pressure is transmitted through fluid passageways 93*b* or 94*b*, causing pressure responsive valves 93 or 94, respectively, to open thus permitting intercommunication of fluid between the base and rod ends of the cylinder member and permitting the movement of arm member 13 in order to prevent damage thereto by such excessive load.

Figure 6:
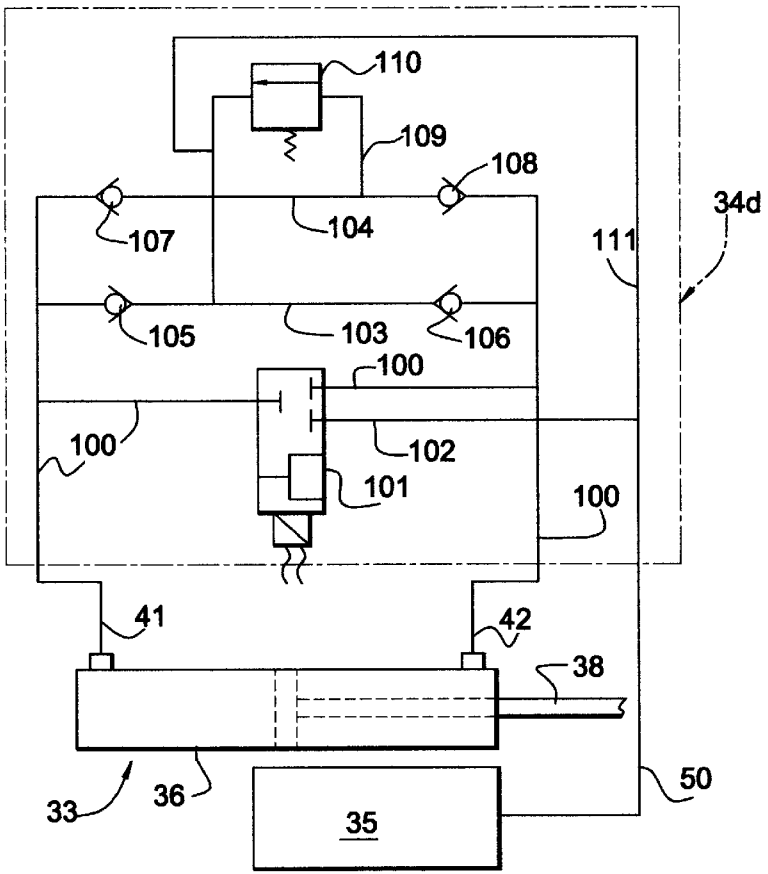
FIG. 6 is a diagrammatic drawing of an even further embodiment of the strut assembly shown in FIG. 1.

The embodiment shown in FIG. 6 includes a control valve 34*d* which is similar in construction and operation to valve 34*a* shown in FIG. 3. Control valve 34*d* includes a fluid passageway 100 intercommunicating the base and rod ends of cylinder member 36 through fluid lines 41 and 42, and including an electrically operated valve 101 normally disposed in the closed condition. The valve includes a fluid passageway 102 intercommunicating fluid passageway 100 with fluid line 50 of accumulator 35 when valve 101 is in the open condition, a fluid passageway 103 interconnecting portions of fluid passageway 100 and disposed in parallel with valve 101 and a fluid passageway 104 also interconnecting portions of fluid passageway 100 and also disposed in parallel with valve 101. Passageway 103 includes a pair of check valves 105 and 106 allowing the flow of fluid only in the direction of fluid passageway 100. Fluid passageway 104 includes a pair of check valves 107 and 108 permitting the flow of fluid only in a direction from fluid passageway 100. Portions of fluid passageways 103 and 104 disposed between the check valves therein are interconnected by a fluid passageway 109 provided with a pressure relief valve 110. A fluid passageway 111 intercommunicates fluid passageway 102 communicating with accumulator 35 and the portion of fluid passageway 109 intercommunicating fluid passageway 103 and pressure relief valve 110.

In the operation of control valve 34*d*, whenever valve 101 is opened and the front end of the machine is operated in a manner to adjust the angle of arm member 13 relative to handle 12 and rod member 38 is caused to retract, fluid from the base end of cylinder member 36 will be caused to flow through fluid passageway 100 and valve 101 to the rod end of the cylinder. Excess fluid from the base end of the cylinder member will be caused to flow through fluid passageway 102 and fluid line 50 to accumulator 35. When rod member 38 is extended, fluid will flow in the opposite direction from the rod end of cylinder member 36 to the base end thereof. A deficiency of fluid will be compensated for by a supply of fluid provided by accumulator 35. Whenever the arm member is in the position desired by the operator, he may fix such position merely by closing valve 101. With valve 101 in the closed position, whenever excess load is imposed on arm member 13, pressure relief valve 110 will be caused to open thus permitting intercommunication of fluid between the base and rod ends of cylinder member 36, allowing arm member 13 to pivot relative to handle 12 to relieve the arm member of such excessive load being imposed thereon.

Figure 7:
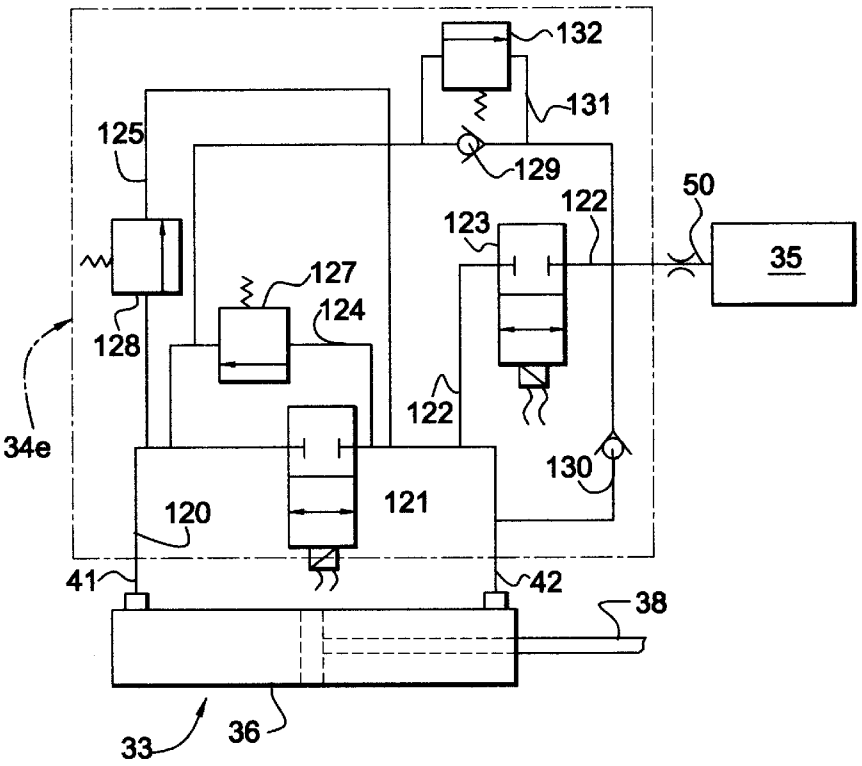
FIG. 7 is a diagrammatic drawing of another embodiment of the strut assembly shown in FIG. 1.

The strut assembly shown in FIG. 7 includes a further modified control valve 34e. Such valve includes a fluid passageway 120 intercommunicating the base and rod ends of cylinder member 36, and including an electrically operated valve 121 normally disposed in a closed condition. A fluid passageway 122 intercommunicates fluid passageway 120 on the rod end side of valve 121 and fluid line 50 of accumulator 35, and includes an electrically operated valve 123 normally disposed in the closed condition. The valve further includes fluid passageways 124, 125 and 126, each intercommunicating passageway 120 on opposite sides of valve 121. Passageway 124 is provided with a pressure release valve 127 which is operable to open upon the attainment of a predetermined pressure in the rod end of cylinder member 36 to provide a bypass of valve 121. Passageway 125 includes a pressure relief valve 128 which normally is in the closed condition and is operable to open upon the attainment of a predetermined pressure in the base end of cylinder member 36. Passageway 126 includes a pair of check valves 129 and 130 and further communicates with passageway 122 between valve 123 and accumulator 35. Such check valves are adapted to open to allow the flow of fluid from accumulator 35 to either end of cylinder member 36. A further passageway 131 communicates with passageway 126 on opposite sides of check valve 129 and includes a pressure relief valve 132.

Control valve 34*e* operates in a manner whereby when valves 121 and 123 are opened and rod member 38 is retracted, fluid from the base end of cylinder member 36 will flow through passageway 120 to the rod end thereof and excess fluid will flow through passageway 122 to accumulator 35. When valve 121 is in the opened condition and rod member 38 is extended, fluid from the rod end of cylinder member 36 will flow through passageway 120 to the base end of the cylinder. The deficiency of fluid is compensated for by a supply of fluid from the accumulator through passageway 126.

Figure 8:
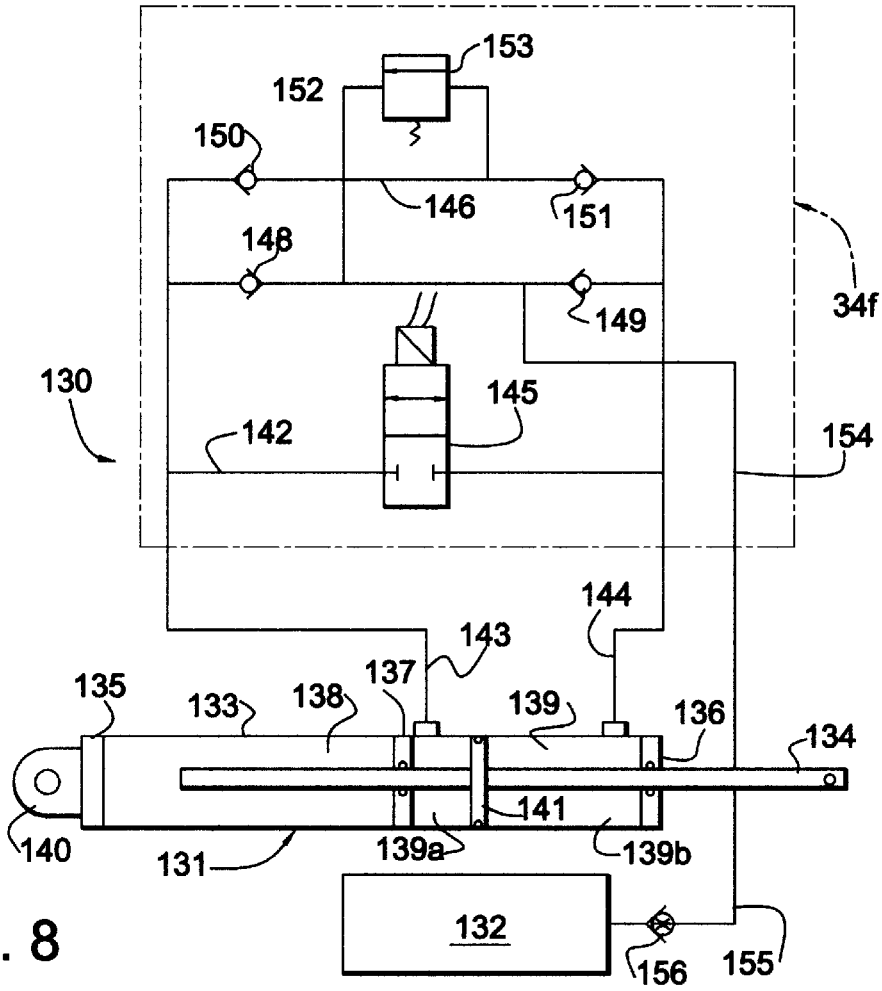
FIG. 8 is a diagrammatic drawing of still another embodiment of the assembly shown in FIG. 1.

FIG. 8 illustrates a strut assembly 130 including a cylinder assembly 131, a control valve 34f and, optionally, an accumulator 132. Cylinder assembly 131 functions substantially the same as cylinder assembly 33 shown in FIGS. 1 through 7, interconnecting bracket 18 depending from the underside of dipper stick 12 and depending arm member 13, and includes a cylinder member 133 and a rod member 134. The cylinder member includes a pair of end walls 135 and 136 and an intermediate wall 137 providing a pair of chambers 138 and 139. End wall 135 is provided with a lug 140 which is adapted to be connected to depending bracket 18 by means of connecting pin 37. Rod member 134 extends through aligned openings in end wall 136 and intermediate wall 137, and is provided with a head section 141 cooperating with end wall 136 and intermediate wall 137 to provide variable volume chambers 139*a* and 139*b*. The outer end of rod member 134 is adapted to be connected to arm member 13 by means of connecting pin 39.

Control valve 34*f* includes a fluid passageway 142 intercommunicating variable volume chambers 139*a* and 139*b* by means of fluid lines 143 and 144, and including an electrically actuated valve 145 normally disposed in the closed condition, a fluid passageway 146 disposed parallel to a segment of fluid passageway 142 including valve 145 and a passageway 147 also disposed parallel to a segment of fluid passageway 142 including valve 145. Fluid passageway 146 is provided with a pair of check valves 148 and 149 permitting fluid flow therefrom only to passageway 142, and fluid passageway 147 is provided with a pair of check valves 150 and 151 permitting fluid flow only from fluid passageway 142. Segments of fluid passageways 146 and 147 disposed between the check valves therein are interconnected by a fluid line 152 provided with a pressure relief valve 153. Optionally, accumulator 132 is connected to a segment of fluid passageway 146, between check valves 148 and 149 by a fluid passageway 154 connected to fluid line 155. A check valve 156 is provided in fluid line 155 which functions to permit the free flow of fluid out of the accumulator and restricted flow of fluid into the accumulator.

Whenever it is desired to adjust the angular relationship of arm member 13 relative to dipper stick 12, appropriate controls on the machine are operated to cause initially the free end of the arm member to engage the ground, then valve 145 to open and thus provide intercommunication between variable volume chambers 139*a* and 139*b*, and finally to maneuver the boom and dipper stick to position the arm member at the desired angle relative to the dipper stick. When such position has been achieved, the controls are operated to close valve 145 thereby fixing the length of strut assembly 135 and correspondingly the angular relationship of the arm member relative to the dipper stick. Because of the construction of rod member 134, extending in both directions from head section 141, the use of an accumulator to compensate for the volume differential on opposite sides of the head section of the rod member as in the previously described embodiments is unnecessary. Optionally, however, accumulator 132 may be provided to compensate for any fluid differential that otherwise may occur in the system.

As in the previous embodiments, whenever an excess load is imposed on the arm member in either direction, relief valve 159 will be caused to open thereby providing intercommunication between variable volume chambers 139*a* and 139*b*, allowing rod member 134 to extend or retract and thus alleviate the load being applied to the arm member. Valve 153 is set to open a predetermined pressure and essentially functions to bypass check valves 150 or 151, depending on the direction of the application of the excessive load on arm member 13.

Figure 9:
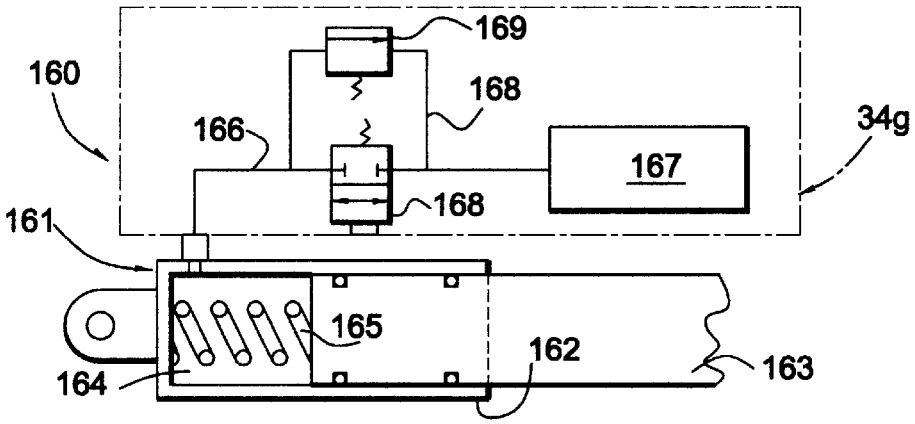
FIG. 9 is a diagrammatic drawing of another embodiment of the invention.
Figure 10:
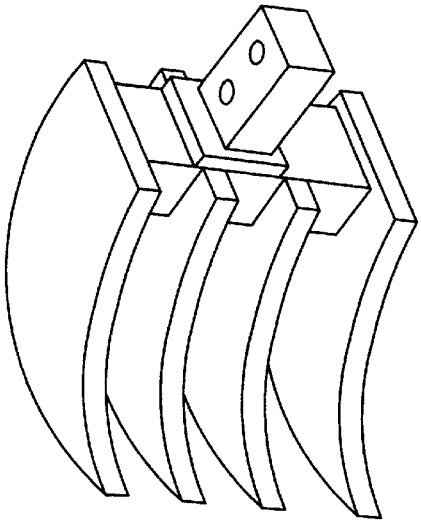
FIG. 10 (PRIOR ART)
FIG. 10 shows an attachment in the form of a conventional rake.
Figure 11:
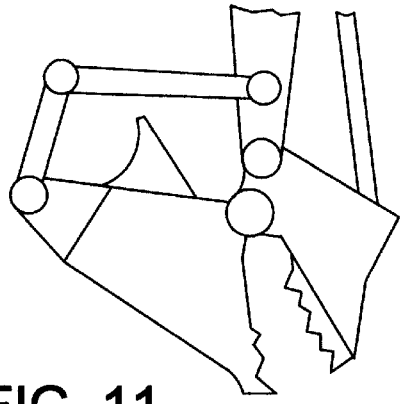
FIG. 11 (PRIOR ART)
FIG. 11 shows an attachment in the form of a conventional crusher jaw.
Figure 12:
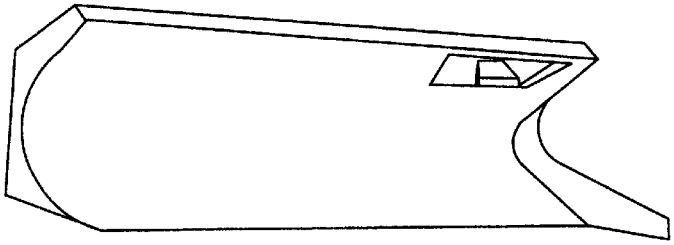
FIG. 12 (PRIOR ART)
FIG. 12 shows an attachment in the form of a conventional shear blade.
Figure 13:
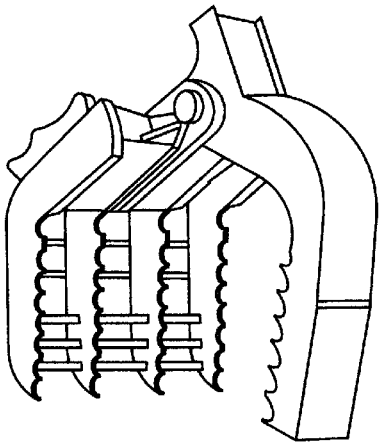
FIG. 13 (PRIOR ART)
FIG. 13 shows an attachment in the form of a conventional grapple arm.

The embodiment shown in FIG. 9 consists of a strut assembly 160 including a cylinder assembly 161 and a control valve 34*g*. The cylinder assembly includes a cylinder member 162 which may be connected at its base end to depending bracket 18 on the dipper stick, a rod member 163 connected to arm member 13 by means of a connecting pin, cooperating with the cylinder member to provide a fluid chamber 164, and a retainer spring 165 disposed within chamber 164 and interconnecting the base wall of the cylinder member and an inner end of the rod member to prevent disconnection of the rod member relative to the cylinder member yet permit normal displacement of the rod member within the cylinder member. Control valve 34*g* essentially consists of a fluid passageway 166 interconnecting the chamber of the cylinder member and accumulator 167. The fluid passageway is provided with then electrically actuated valve 168 normally disposed in the closed condition. A fluid line 168 provided with a pressure relief valve 169 is connected to fluid passageway 166 in a parallel relationship to valve 168.

Upon opening valve 168, fluid will be readily supplied to or from cylinder chamber 164 to permit rod member 163 to correspondingly extend or retract and thus permit the positioning of arm member 13 relative to the dipper stick in the manner as previously described. Upon closure of valve 168, the confinement of fluid in cylinder chamber 164 will prevent the displacement of rod member 163 thus fixing the position of the arm member relative to the dipper stick. Spring 165 functions not only to retain the inner end of the rod member within the cylinder member but to permit its displacement relative to the cylinder member for adjusting the position of the arm member. Upon the application of excessive loads on the arm member once set in position and used to perform a work function, relief valve 169 will be caused to open and thus relieve the load imposed on the arm member.

In each of the above described strut assemblies, it will be appreciated that the angular relationship of arm member 13 relative to handle 12 may be adjusted by the machine operator simply by operating one or more electrically actuated valves to either allow intercommunication of fluid between the base and rod ends of the cylinder member or the free flow of fluid to and from a single chamber of the cylinder member of the strut assembly, and maneuvering other controls at the operator's station to engage the free end of arm member 13 with the ground and maneuver the other components of the front end of the machine to provide the desired angular relationship between the arm member and the handle. Once the arm member has been set, its angular relationship with the handle may be fixed simply by operating suitable controls to close one or more valves in the control valve of the assembly to lock the rod member of the cylinder assembly relative to the cylinder member thereof. In the use of the device, whenever any excessive loads are imposed on arm member 13, pressure release valves within the control valve function to override the locking valves of the assembly to permit displacement of the arm member, thereby preventing damage to the arm member and/or the strut assembly.

It is contemplated within the scope of the invention that arm member 13 may consist of simply a "thumb" member as shown in the drawings or any other form of implement including a bucket, rake, grapple jaw, shear blade or crusher jaw. Arm member 13 may be operated independently or in combination with another component pivotally connected to the handle such as bucket 15 shown in the drawings. Any other component mounted on the handle and cooperating with arm member 13 also may consist of a bucket, rake, grapple jaw, shear blade, crusher blade and the like.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

What is claimed is:

1. An attachment connectable to a boom member of a machine for performing work functions comprising:

a first arm member pivotally connectable to said boom member;

a second arm member pivotally connected to said first arm member; and an extendible strut assembly interconnecting said first and second arm members including a hydraulic cylinder assembly having a cylinder member pivotally connected to one of said first and second arm members and a rod member pivotally connected to the other of said first and second arm members, and having means intercommunicating the base and rod ends of said cylinder member, at least one electrically operable valve disposed in said intercommunicating means and operatively connectable to control means disposed on said machine, selectively operable to open said valve and permit the free flow of fluid between the base and rod ends of said cylinder member, and correspondingly the angular displacement of said second arm member relative to said first arm member upon maneuvering said first arm member by an operator of said machine, and to close said valve and preclude the free flow of fluid between the base and rod ends of said cylinder member, and correspondingly the angular displacement of said second arm member relative to said first arm member, and an accumulator selectively communicable with the variable volume chambers of said cylinder member for compensating for the fluid volume requirements of said chambers.

2. An attachment according to claim 1 including:

a third arm member pivotally connected to said first arm member; and means for pivoting said third arm member relative to said first arm member.

3. An attachment according to claim 2 wherein said third arm member comprises a bucket.

4. An attachment according to claim 2 wherein said third arm member comprises a grapple arm member.

5. An attachment according to claim 2 wherein said third arm member comprises a rake.

6. An attachment according to claim 2 wherein said third arm member comprises a crusher jaw.

7. An attachment according to claim 2 wherein said third arm member comprises a shear blade.

8. An extendible strut assembly for an arm member pivotally connected to a handle pivotally connected to a machine for performing work functions comprising:

a hydraulic cylinder assembly having a cylinder member pivotally connectable to one of said handle and said arm member and a rod member pivotally connectable to the other of said handle and said arm member;

means intercommunicating the base and rod ends of said cylinder member including at least one electrically operable valve disposed in said intercommunicating means and operatively connectable to control means disposed on said machine, selectively operable to open said valve and permit the free flow of fluid between the base and rod ends of said cylinder member, and correspondingly the angular displacement of said arm member relative to said handle upon maneuver of said arm member by an operator of said machine, and to close said valve and preclude the free flow of fluid between the base and rod ends of said cylinder member, and correspondingly the preclusion of the angular displacement of said arm member relative to said handle, respectively; and an accumulator selectively communicable with the variable volume chambers of said cylinder member for compensating for the fluid volume requirements of said chambers.

9. An extendible strut assembly according to claim 8 including at least one pressure relief valve communicable with at least a base or rod end of said cylinder, operable to allow the flow of fluid from an end of said cylinder assembly upon the imposition of a predetermined excessive load on said arm member.

10. An extendible strut assembly according to claim 9 wherein said pressure relief valve is disposed in a fluid passageway intercommunicating the base and rod ends of said cylinder, operable to provide intercommunication between the base and rod ends of said cylinder upon imposition of said excessive load.

11. An extendible strut assembly according to claim 9 including a fluid passageway intercommunicating the base and rod ends of said cylinder having a pressure relief valve operable to open upon attainment of a predetermined pressure in one of the chambers of said cylinder member and a fluid passageway intercommunicating the base and rod ends of said cylinder member having a pressure relief valve operable to open responsive to a predetermined pressure in the other chamber of said cylinder member.

12. An extendible strut assembly according to claim 10 including means intercommunicating said passageway including said pressure relief valve, and said accumulator.

13. An extendible strut assembly for an arm member pivotally connected to a handle pivotally connected to a machine for performing work functions comprising:

a hydraulic cylinder assembly having a cylinder member pivotally connectable to one of said handle and arm members and a rod member pivotally connectable to the other of said handle and arm members;

an accumulator; and means defining a fluid passageway intercommunicating a chamber of said assembly and said accumulator, including an electrically operable valve disposed therein and operatively connectable to control means disposed on said machine, selectively operable to open said valve and permit the free flow of fluid between said chamber and said accumulator, and correspondingly the angular displacement of said arm member relative to said handle upon maneuver of said arm member by an operator of said machine, and to close said valve and preclude the free flow of fluid between said chamber and said accumulator, and correspondingly the preclusion of the angular displacement of said arm member relative to said handle.

14. An extendible strut assembly according to claim 13 including means interconnecting said cylinder and rod members for preventing a disconnection thereof.

15. An extendible strut assembly according to claim 14 wherein said means for preventing disconnection of said cylinder and rod members comprises a spring.

16. An extendible strut assembly according to claim 13 including a pressure relief valve disposed in a fluid passageway intercommunicating said chamber and said accumulator, operable to provide intercommunication between said chamber and said accumulator upon imposition of a predetermined excessive load on said arm member.

* * * * *